United States Patent [19]

Jarm

[11] 4,186,577

[45] Feb. 5, 1980

[54] LOCK OPENING DEVICE

[75] Inventor: Robert L. Jarm, Wauconda, Ill.

[73] Assignee: Credit Industry Associates, Inc., Arlington Heights, Ill.

[21] Appl. No.: 924,978

[22] Filed: Jul. 17, 1978

[51] Int. Cl.[2] ..... E05B 19/20

[52] U.S. Cl. ..... 70/394; 33/174 F

[58] Field of Search ..... 70/394; 33/174 F, 174 P, 33/174 PA, 175, 176

[56] References Cited

U.S. PATENT DOCUMENTS

| | | | |
|---|---|---|---|
| 2,720,032 | 10/1955 | Harwell | 33/174 F |
| 2,727,312 | 12/1955 | Tampke | 33/174 F |
| 3,827,151 | 8/1974 | Naill | 70/394 |

*Primary Examiner*—Robert L. Wolfe

*Attorney, Agent, or Firm*—Keil & Witherspoon

[57] ABSTRACT

A device for opening a lock without the use of a key cut to the specific tumbler configuration of the lock, said device comprising a holder having a key blank corresponding to the key slot formed in the lock core mounted at one end thereof. A resilient member is secured to the key blank in such a position that it will engage the tumblers of the lock when the key blank is inserted into the key slot. In addition, a means is secured to the holder for engaging the lock housing in which said core rotates on the side thereof opposite the location of the tumblers and for urging the key blank and core against said engaged side in a manner such that the width of the shear line between the core and lock housing will be increased at the location of the tumblers. By adjusting the alignment of the key blank within the lock core, the spring-loaded tumblers will be caused to deform the resilient member at various depths until they are brought into the desired alignment along the shear line betwen the core and lock housing thereby permitting the rotation of the core within said lock housing.

10 Claims, 6 Drawing Figures

LOCK OPENING DEVICE

INTRODUCTION

The present invention relates generally to a device for opening locks and, more particularly, to a device for quickly and easily opening locks without the use of a key cut to the specific tumbler configuration of the lock. Although the description of the lock tool of the present invention given below is directed to use with automobile-type pin tumbler ignition locks, it is to be understood that with slight modification falling within the scope of the present invention, it may be used with side bar automobile locks or a wide variety of non-automotive locks utilizing such general operating principles.

BACKGROUND OF THE INVENTION

The majority of late-model automobiles are equipped with anti-theft devices which lock the steering wheel in place when the ignition switch is in the "off" position. Therefore, in order to safely drive the automobile when the ignition key is lost or unavailable, it is necessary to completely disassemble the steering column or otherwise extract the lock of the ignition lock assembly so as to permit disengagement of the anti-theft lock.

Although various devices are presently known to locksmiths and automobile repossessors for extracting the ignition lock without disassembling the entire steering column, it has been found that a number of practical problems and drawbacks have been associated with their use. For example, many of such devices are slow and cumbersome to use, are noisy in their operation, or are suited for use with only a limited number of automobile models. Furthermore, many of such devices have a tendency to greatly damage the ignition lock assembly or mar the surrounding steering column or dashboard surfaces in use.

Likewise, it is known that such ignition locks may be "picked" with special hook-shaped picking devices which individually position each tumbler pin at its opening position along the shear line between the lock core and housing which enables the core to be turned within the housing. However, the use of such lock picking devices is generally extremely slow and tedious and requires a great deal of skill on the part of the operation.

BRIEF DESCRIPTION OF THE INVENTION

The present invention eliminates the above-mentioned problems and drawbacks found with conventional lock extracting and opening devices by providing a tool which quickly and easily opens ignition locks without the necessity of extracting the lock or utilizing a lock picking device and without damaging the lock in any way.

The device consists essentially of a holder having a key blank corresponding to the key slot formed in the lock core mounted at one end thereof. A resilient member such as a rubber insert is secured to the key blank in a position such that it will engage the lock tumblers when the key blank is inserted into the key slot of the lock core. A hook-like actuating lever is pivotally secured to the holder in a manner such that it may engage the lock housing on the side thereof opposite the tumblers so as to urge the key blank and lock core against this engaged side of the housing thereby increasing the width of the shear line between the core and housing at the tumbler location, thereby making it substantially easier to properly align the spring-loaded tumblers along the shear line so as to allow the core to be rotated.

In operation, the alignment of the key blank is adjusted from side to side within the core while the actuating lever is held in engagement with the lock housing thereby causing the tumblers to deform the resilient member at various depths until they are brought into proper alignment along the widened shear line between the lock core and housing. Once this is accomplished, the actuating lever is withdrawn from engagement with the housing and the lock core is rotated with the key blank in the same manner as if the original key to the lock were being used.

Since the resilient member of the tool manipulates the tumblers until they are simultaneously brought into proper alignment along the shear line between the lock core and housing, no special skill is required to quickly and easily open the lock with the use of the tool. Likewise, it is not possible to damage the tumblers or any other portion of the lock mechanism with the use of the tool.

DESCRIPTION OF THE PREFERRED EMBODIMENT

Figure 1:
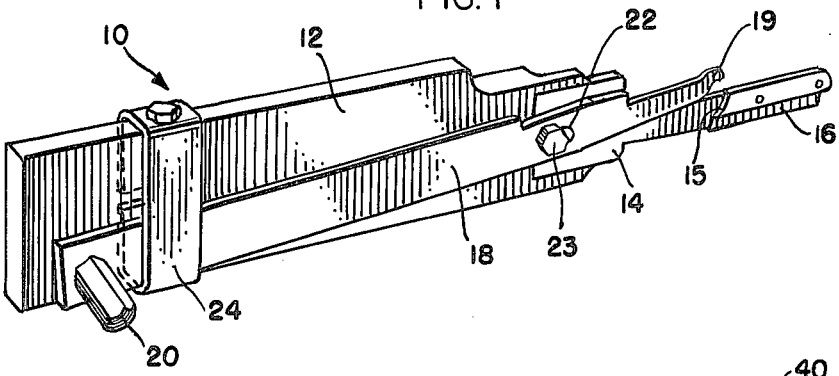
FIG. 1 is a perspective view of a lock opening device constructed in accordance with an embodiment of the present invention.
Figure 2:
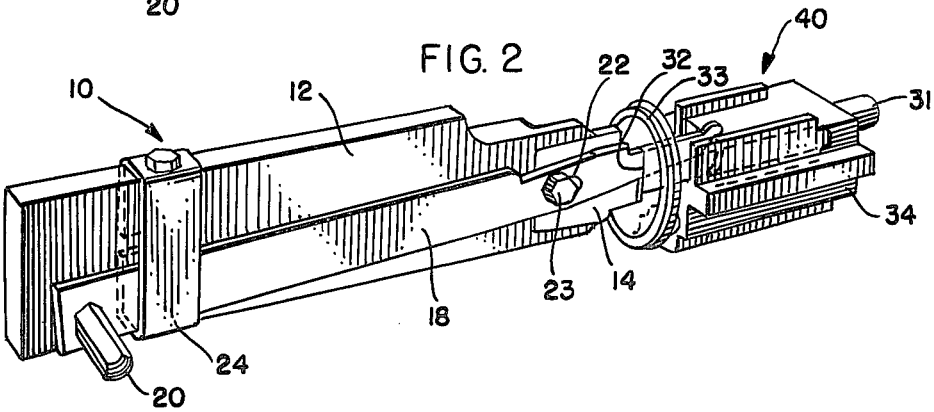
FIG. 2 is a perspective view of the device illustrated in FIG. 1 shown inserted into a lock assembly.

FIGS. 1 and 2 generally illustrate an embodiment of a lock opening device 10 constructed in accordance with the present invention. The device comprises a handle or holder portion 12 having a key blank 14 mounted at one end thereof. Secured to that portion of the key blank which is to be inserted into the lock key slot is a resilient member 16 which may be made of rubber or similar deformable material. A hook-like actuating lever 18 is pivotally secured to holder 12 in a manner such that its hooked end 19 can be brought into engagement with a portion of the lock housing through the manipulation of lever button 20. This operation is aided by forming an elongated slot 22 in lever 18 which permits it to be rotated up and down and slid back and forth about pivot post 23. The end of lever 18 in the vicinity of button 20 is loosely held in place by clamp 24 which permits the above-described movement of the actuating lever.

Figure 3:
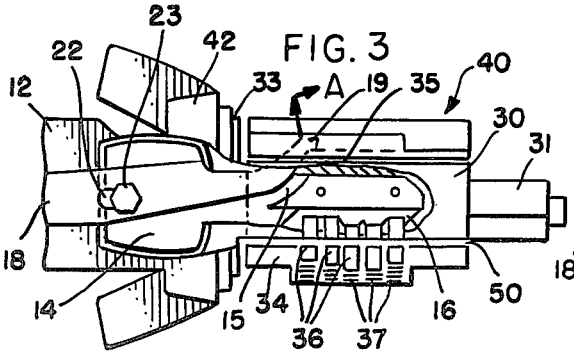
FIG. 3 is a cut-away side view of a portion of the device shown in FIG. 2.
Figure 4:
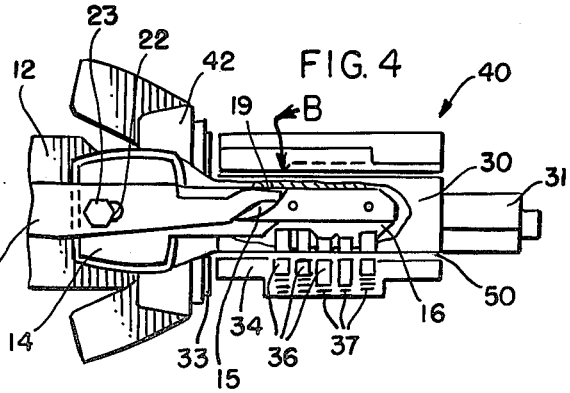
FIG. 4 is a cut-away side view similar to FIG. 3 showing the device in a different operational position within the lock assembly.

Referring now also to FIGS. 3 and 4, key blank 14 is shown inserted into key slot 32 formed in core 30 of ignition lock assembly 40. Lock assembly 40 also consists of a lock housing 34 in which core 30 may rotate, thereby operating the ignition of the vehicle and disengaging the anti-theft mechanism through the rotation of tail piece 31. However, in order for core 30 to rotate within lock housing 34, the two-piece tumbler pins 36 must be brought into the stepped pattern along the shear line 50 between the core and housing as is shown in FIGS. 3 and 4. In the locked position of the assembly, pins 36 are urged into a random, blocking pattern between core 30 and housing 34 due to the pressure exerted by pin spring 37. In the normal operation of the lock, the key for the lock will be cut to the various tumbler lengths corresponding to the shear line 50 between the core and housing, thereby permitting the core to be rotated when the key is inserted.

However, with the use of the present invention, the lock assembly may be opened in a similar fashion without the use of a key specifically cut to the tumbler lengths. This operation is illustrated best by reference to FIGS. 2–4. Initially, key blank 14 is inserted into key slot 32 of lock core 30 with the hooked end 19 of actuating lever 18 nestled within notch 15 formed along the side of key blank 14 (see FIG. 4). This allows the lever to clear the slot formed in chrome ring 42 and the slot formed in the face plate 33 which is secured to core 30. Once the key blank is seated fully within the lock core 30, button 20 is pushed downward and then forward causing hooked end 19 to move upward and forward over the lip portion 35 of lock housing 34 as is shown by arrows A in FIG. 3. Once engaged with lip portion 35, the button 20 is pushed upward thereby forcing the core into an abutting relationship with that portion of the housing opposite tumbler pins 36. In this manner, the width of shear line 50 at the location of the tumbler pins is substantially increased due to the overall play generally existing between the core and lock housing. (Compare shear line 50 in FIG. 3 with that shown in FIG. 4). With a Ford ignition lock, lip portion 35 of lock housing 34 is located in front of the area occupied by the ignition key buzzer switch assembly. A spring (not shown) which is located in this area on Ford ignition locks also tends to force the core away from the lock housing thereby decreasing the shear line 50 at the tumbler location. Hence, the operation of the actuating lever of the present invention also serves to overcome this spring force thereby increasing the width of the shear line at the tumblers.

As can be seen in FIGS. 3 and 4, when the key blank is fully inserted within core 30, resilient member 16 will be upwardly deformed by tumbler pins 36 being pushed against it by pin springs 37. Hence, since the relative hardness of resilient member 16 will determine how deeply tumbler pins 36 will deform it and, consequentially, how closely they will align themselves along shear line 50, the hardness of the resilient member must be selected so as to correspond to the force exerted by the springs 37 upon tumbler pins 36. It has been found that a durometer hardness of 25 to 40 units for resilient member 16 will provide an average tumbler pin deformation corresponding to a 3-cut on late-model Ford ignition locks having their tumbler pins cut to standard lengths between 1 and 5.

Once the tool has been brought into the position shown in FIG. 3, the operator gently moves holder 12 and key blank 14 up and down within core 30 while maintaining an upward pressure on button 20 and while imparting a gentle turning force on the entire tool. The turning force will be in the direction in which it is desired to turn the lock core in order to open it (generally to the right when facing the lock). This movement of the tool within the lock will cause the tumbler pins 36 to randomly move into and away from resilient portion 16 until the desired alignment along shear line 50 is achieved. Since shear line 50 is maintained at its maximum width due to the action of lever 18, tumbler pins 36 need only move slightly within resilient member 16 in order to open the lock even if they are cut at their maximum and minimum standard depths.

Once the pin halves separate and the lock core begins to rotate, the operator will retract the hooked end 19 of the actuating lever back into its flush position within recess 15 of key blank 14 in the direction illustrated by arrows B of FIG. 4 by moving button 20 rearward and upward. Once this is accomplished, the key blank will clear the internal elements of the lock assembly thereby allowing the full rotation of core 30 within lock housing 34. Since resilient member 16 is made of a soft rubber or similar material, the tool may be withdrawn from the lock assembly at this point without damage to the protruding tumbler pin halves contained in the core.

Figure 5:
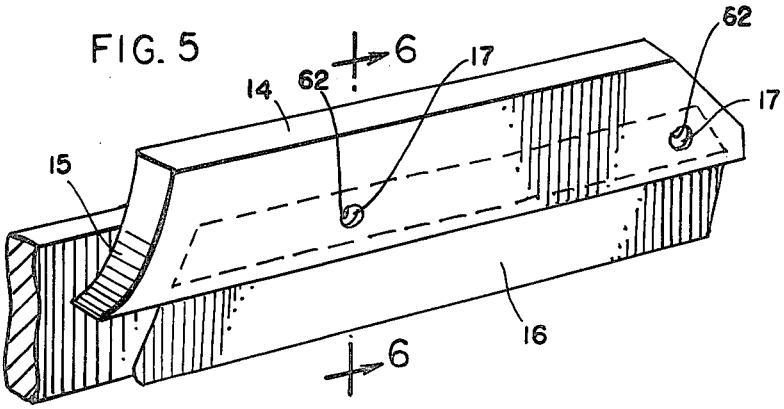
FIG. 5 is an enlarged perspective view of a portion of the device shown in FIG. 1.
Figure 6:
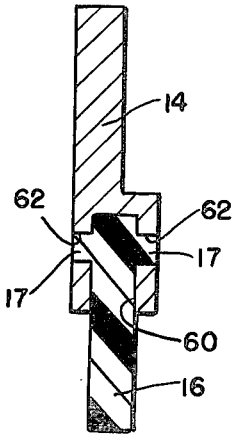
FIG. 6 is an end sectional view taken along line 6—6 of FIG. 5.

Since the soft resilient member 16 may become quickly worn by the action of the tumbler pins upon it during the opening of the lock and withdrawal of the tool, it has been found desirable to construct the member as a replacable insert as is shown in FIGS. 5 and 6. With this embodiment, a channel 60 is cut into the key blank 14 into which resilient member 16 is fitted. In order to insure that the insert is firmly maintained within the key blank 14, several holes 62 may be formed along the sides of channel 60 into which ears 17 formed on the corresponding portions of resilient member 16 are fitted. When the resilient member 16 is fitted into key blank 14 in this manner, it has been found that it will not substantially shift its position within the key blank during normal use of the lock tool. In the alternative, resilient member 16 may be directly bonded or molded to key blank 14 and the entire key blank assembly then becomes the replacable portion of the tool.

While several particular embodiments of the present invention have been shown and described, it should be understood that various obvious changes and modifications thereto may be made, and it is therefore intended in the following claims to include all such modifications and changes as may fall within the spirit and scope of this invention.

What is claimed is:

1. A device for opening a lock of the type wherein a lock core having a key slot formed therein rotates within a fixed housing, a series of spring-loaded tumblers being located between said core and housing which must be brought into alignment along the shear line therebetween in order to permit the rotation of said core, said device comprising:

a holder having a key blank corresponding to the key slot formed in said core mounted at one end thereof;

a resilient member secured to said key blank in a position such that it engages said tumblers when said key blank is inserted into said key slot;

a means secured to said holder for engaging said housing on the side thereof opposite said tumblers and for urging said key blank and core against said engaged side in a manner such that the width of the shear line between said core and housing will be increased at the location of said tumblers, whereby adjusting the alignment of said key blank within said core will cause said spring-loaded tumblers to deform said resilient member at various depths until they are brought into proper alignment along said shear line thereby permitting the rotation of said core within said housing.

2. The device of claim 1 wherein said resilient member is formed as a removable insert which is mounted in a channel cut into said key blank.

3. The device of claim 1 wherein said resilient member is bonded directly to said key blank and said key blank is removably secured to said holder.

4. The device of claim 1 wherein said resilient member is constructed of a material having a durometer hardness of between 25 to 40 units.

5. The device of claim 1 wherein said resilient member is constructed of rubber.

6. The device of claim 1 wherein said engaging means comprises a lever which is pivotally secured to said holder and which has a hooked end for engaging said housing.

7. The device of claim 6 wherein said lever has a slotted opening formed therein through which it is secured to said holder, said slotted opening permitting said lever to be both pivoted and slid back and forth with respect to said holder.

8. The device of claim 7 wherein said key blank has a notch formed along its side into which said hooked end may be rotated.

9. The device of claim 8 wherein said lever has an actuating button secured at its end opposite said hooked end.

10. The device of claim 1 wherein said key blank is mounted on the end of said holder in a manner which permits the limited movement thereof with respect to said holder.

* * * * *